US005921478A

United States Patent [19]

Kamiwano et al.

[11] Patent Number: 5,921,478

[45] Date of Patent: Jul. 13, 1999

[54] DISPERSION METHOD AND DISPERSING APPARATUS USING SUPERCRITICAL STATE

[75] Inventors: Mitsuo Kamiwano; Kazuhiko Nishi, both of Yokohama; Yoshitaka Inoue, Tokyo, all of Japan

[73] Assignee: Inoue MFG., Inc., Japan

[21] Appl. No.: 08/975,367

[22] Filed: Nov. 20, 1997

[30] Foreign Application Priority Data

Dec. 27, 1996 [JP] Japan ..... 8-358871

[51] Int. Cl.[6] ..... B02C 19/06; B02C 19/12

[52] U.S. Cl. ..... 241/5; 241/15; 241/17; 241/38

[58] Field of Search ..... 241/5, 15, 21, 241/38, 39, 2, 17

[56] References Cited

U.S. PATENT DOCUMENTS

| | | | |
|---|---|---|---|
| 4,582,731 | 4/1986 | Smith | 427/421 |
| 4,848,673 | 7/1989 | Masuda et al. | 241/5 |
| 5,096,744 | 3/1992 | Taket et al. | 427/213 |
| 5,346,141 | 9/1994 | Kim et al. | 241/5 |
| 5,522,555 | 6/1996 | Poole | 241/33 |
| 5,695,132 | 12/1997 | Gorzka, Jr. et al. | 241/39 |
| 5,716,751 | 2/1998 | Bertrand et al. | 241/5 X |

*Primary Examiner*—John M. Husar
*Attorney, Agent, or Firm*—Adams & Wilks

[57] ABSTRACT

A dispersion method for uniformly dispersing solid or liquid fine particles in a solvent utilizes a supercritical fluid. A dispersoid of a solid, a liquid or the like is mixed with a solvent, and the resulting mixture is fed to a supercritical vessel. A supercritical solvent is then fed to the supercritical vessel and heated and compressed to a level higher than the critical temperature and critical pressure thereof to convert it to a supercritical fluid. The supercritical fluid and mixture of dispersoid and solvent are mixed together to form a supercritical mixture, which is released to atmospheric pressure in an explosion-crashing tank and subjected to collision within the explosion-crashing tank to efficiently disperse the dispersoid in the solvent.

25 Claims, 15 Drawing Sheets

• supercritical solvent

• supercritical solvent

• supercritical solvent

FIG. 6(H)
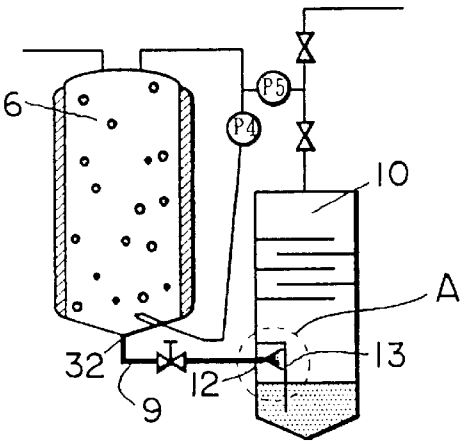
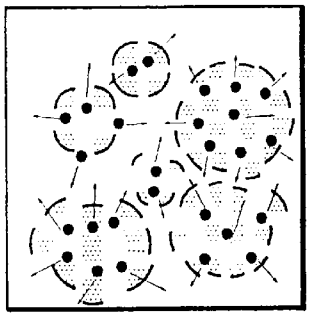
FIG. 6(I)
FIG. 6(F)
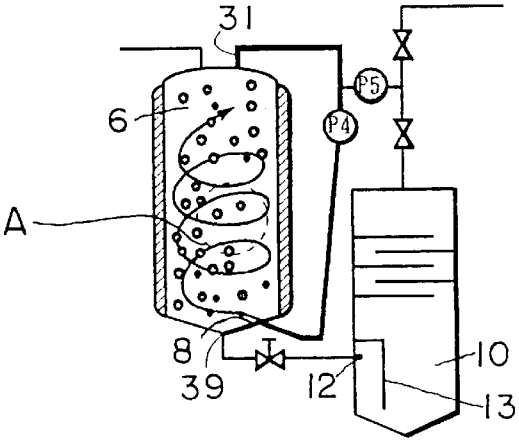
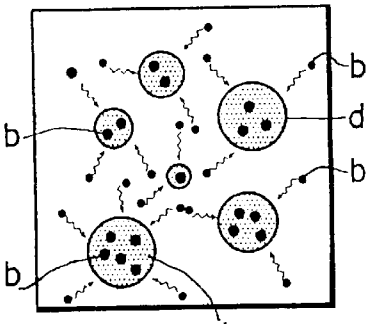
FIG. 6(G)

DISPERSION METHOD AND DISPERSING APPARATUS USING SUPERCRITICAL STATE

BACKGROUND OF THE INVENTION

Field of the Invention

The present invention relates generally to a dispersion method and, more particularly, to a dispersion method for a solid-liquid system wherein a solid composed of fine particles and a liquid are mixed and dispersed, a dispersion method for a liquid-liquid system wherein two liquids are mixed and emulsified, and a dispersion method for a solid-liquid(water)-liquid(organic solvent) system. The dispersion method is characterized by carrying out the dispersion by using a supercritical solvent in a supercritical state as a dispersing means. The present invention also relates to a dispersing apparatus for the dispersion method.

Background Information

There have been employed as dispersing apparatuses a kneader, a roll mill, a medium-dispersing machine and the like to disperse a solid dispersoid used as a material for coatings, inks, ceramics, cosmetics, foods and the like, or a homogenizer and the like to emulsify a liquid dispersoid. In the foregoing dispersion methods, shearing forces are usually mechanically applied to particles to be dispersed to finely divide the particles, resulting in a long processing time and problems when the dispersing apparatus is washed after completion of the dispersion process.

In an effort to improve the foregoing conventional dispersion methods, there has been proposed a dispersion method wherein a solvent and a dispersoid are mixed in a supercritical state and the solvent is rapidly expanded to finely divide the dispersoid, and then the fine particles are blown into a solvent such as varnish, toluene or the like. However, in such a dispersion method, when the fine particles are blown into the solvent, reagglomeration is likely to take place, whereby the dispersed condition will deteriorate.

SUMMARY OF THE INVENTION

The present invention is intended to utilize the characteristics of a supercritical fluid which is capable of continuously and rapidly changing the density from a gaseous density to a liquid density by changing the pressure and temperature.

It is accordingly an object of the present invention to provide a dispersion method and a dispersing apparatus by which a solid or liquid dispersoid can be efficiently dispersed without causing the above-mentioned drawbacks in the conventional art.

Another object of the present invention is to provide a dispersion method which uses a supercritical solvent in a supercritical state, and a dispersing apparatus for the dispersion method which can be operated by computer control.

The foregoing and other objects of the present invention are carried out by providing a dispersion method using a supercritical solvent in a supercritical state which comprises the steps of feeding a mixture of a dispersoid and a solvent into a supercritical vessel, feeding a supercritical solvent into the supercritical vessel, heating and compressing the supercritical solvent to convert it from a gaseous phase state to a supercritical fluid, mixing the mixture and the supercritical fluid in the supercritical vessel to form a supercritical mixture, and then introducing the supercritical mixture to an explosion-crashing tank. In the explosion-crashing tank, the supercritical mixture is jetted to atmospheric pressure and undergoes collision to thereby disperse the dispersoid into the solvent.

In the present invention, the supercritical solvent represents a solvent for the preparation of the supercritical state. As used herein, the terms "supercritical state" and "supercritical fluid" mean not only a supercritical state and supercritical fluid which exceed the critical state and critical fluid, but also a semi-supercritical state and semi-supercritical fluid which are slightly less than the critical state and critical fluid. However, the semi-supercritical state and semi-supercritical fluid can be deemed to be substantially the same as the above supercritical state and supercritical fluid, since the change of phase transformation takes place in an extremely short period of time.

Furthermore, according to the present invention, the following effects are obtained when the supercritical mixture undergoes collision in the explosion-crashing tank:

(1) When the dispersoid consists of porous particles, the supercritical fluid penetrates into the pores thereof or in narrow spaces between the particles and the pressure is rapidly reduced to cause rapid cubical expansion, by which the porous particles are crashed and dispersed.

(2) The dispersion is jetted in the supercritical state from a nozzle having openings or narrow slits at a sonic speed or supersonic speed, by which a high shear deformation action is applied to the dispersoid for crashing and dispersion.

(3) The jetted liquid is collided against a wall surface or the like by the inertia force corresponding to the mass of fine particles of the jetted liquid, by which impact action is applied to the dispersoid for crashing and dispersion.

In another aspect, the present invention is directed to a dispersing apparatus comprising a supercritical vessel having a supercritical solvent and a mixture of a dispersoid and a solvent, a heating and compressing unit for converting the supercritical solvent within the supercritical vessel to a supercritical fluid, a stirring unit for stirring a supercritical mixture comprised of the supercritical fluid and the dispersoid and solvent mixture in the supercritical vessel, an explosion-crashing tank for colliding the supercritical mixture and releasing the supercritical mixture to atmospheric pressure to disperse the dispersoid, and a storage tank for storing the dispersoid dispersed by the explosion-crashing tank.

BRIEF DESCRIPTION OF THE DRAWINGS

FIG. 1(A) is an explanatory drawing showing a step for charging a slurry; FIG. 1(B) is an explanatory drawing showing a step for preparing a supercritical state; FIG. 1(C) is an explanatory drawing showing a stirring and mixing step when a jet stirring unit is employed; and FIG. 1(D) is an explanatory drawing showing an explosion-crashing step when an explosion-crashing nozzle and a vertical plate-like collision portion are employed.

FIG. 2(A) is an explanatory drawing showing a jet stirring unit; FIG. 2(B) is an explanatory drawing showing an ultrasonic stirring unit; FIG. 2(C) is an explanatory drawing showing a vibration plate actuated by an external shifting magnetic field; and FIG. 2(D) is an explanatory drawing showing rotation blades actuated by an external shifting magnetic field.

FIGS. 3(A) and 3(B) are explanatory drawings showing collision plates each provided with a fence; and FIG. 3(C) is an explanatory drawing showing a case of a countercurrent collision.

FIG. 4(A) shows a step for temperature-pressure operation; FIG. 4(B) shows a density-pressure isothermic chart in the step for temperature-pressure operation; and FIG. 4(C) shows a density-temperature isobar chart in the step for temperature-pressure operation.

FIG. 5(A) shows a step for temperature-pressure operation; FIG. 5(B) shows a density-pressure isothermic chart in the step for temperature-pressure operation; and FIG. 5(C) shows a density-temperature isobar chart in the step for temperature-pressure operation.

FIG. 6(A) is an explanatory drawing showing a step for charging an emulsion; FIG. 6(B) is an explanatory drawing showing a step for preparing a supercritical state; FIG. 6(C) is an explanatory drawing showing a stirring and mixing step when a jet-stirring unit is used; and FIG. 6(D) is an explanatory drawing showing an explosion-crashing step when an explosion-crashing nozzle and a vertical plate-like collision portion are used.

DETAILED DESCRIPTION OF THE PREFERRED EMBODIMENTS

The preferred embodiments of the present invention will be described below with reference to FIGS. 1–9 wherein like numerals designate like elements throughout.

FIGS. 1(A)–1(D) show a case where a dispersoid consisting of solid fine particles a is dispersed in a liquid solvent. The solid fine particles include, for example, ultrafine particles such as pigments, ceramics material powder or magnetic particles, and sometimes also a few types of fine particles. The liquid solvent includes water, an organic solvent or the like which forms a continuous phase in a dispersion. A mixture of the dispersoid and the liquid solvent under suspended condition (rough dispersion) (hereinafter referred to as a "slurry") is charged into a supercritical vessel 6 from a feeding inlet 30 (FIG. 1(A)). At this time, appropriate agents, e.g., a dispersant such as a polymer surfactant, may be incorporated beforehand. At this stage, it is believed that the solid fine particles a are in a so-called agglomerate state, wherein generally several or many solid fine particles form aggregates suspended in the solvent.

The above slurry may be preliminarily dispersed by a preliminary dispersing apparatus before feeding it into the vessel 6, or may be directly fed into the vessel without a preliminary mixing process, depending on the properties of the dispersoid.

The supercritical vessel 6 is then filled with a supercritical solvent through a feeding inlet line which terminates in a jet nozzle 8. The supercritical solvent is heated and compressed by heating and compressing means comprising, for example, a heater and a pump, for the preparation of a supercritical fluid b by bringing the conditions within the vessel 6 above the critical temperature and the critical pressure, respectively (FIG. 1(B)). The supercritical fluid b thus obtained has a higher diffusion coefficient and a smaller surface tension as compared with a liquid solvent such as water or an alcohol, and is therefore likely to be wetted and capable of rapidly penetrating into the aggregates of fine particles a. Further, since the interaction (attraction) between the fine particles a and the supercritical fluid b is larger than the interaction (attraction) between the fine particles to one another, the aggregates of fine particles a are crashed and divided into individual particles, resulting in the progress of primary particle formation, whereby the dispersion of the fine particles is accelerated. At this time, when the fine particles a have pores c, since the supercritical fluid b has a high diffusion coefficient and a small surface tension as mentioned above, the supercritical fluid b impregnates into the pores c of the fine particles a as shown in the enlarged figure in FIG. 1(B).

Figure 1A:
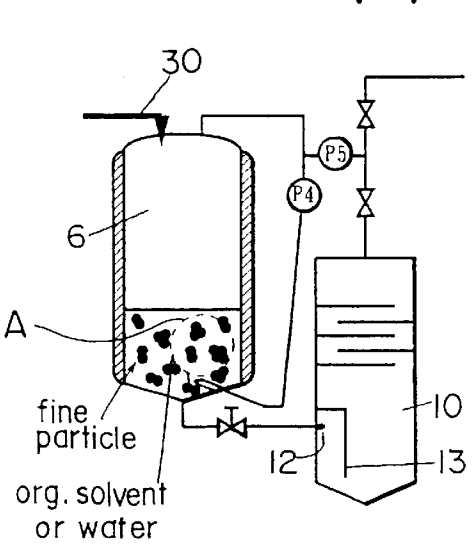
FIGS. 1(A) to 1(D) show dispersion methods of a solid (fine particles)-liquid system according to the present invention, where.
Figure 1B:
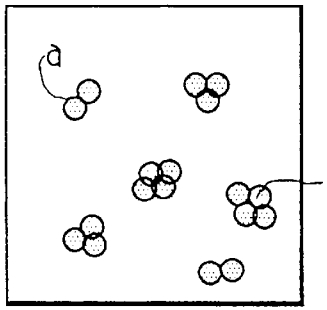
Figure 1C:
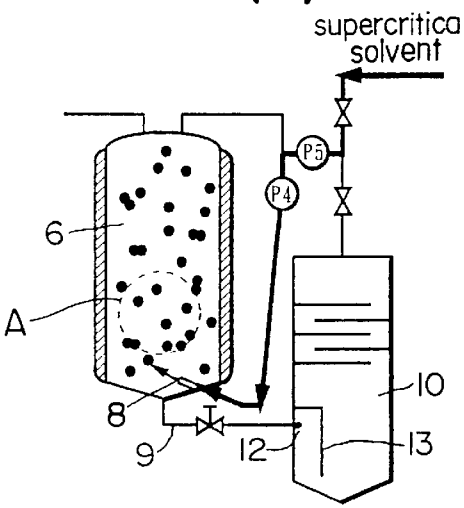

Thereafter, to further advance the formation of primary particles and the impregnation between the particles or into the pores thereof, the supercritical mixture of the slurry and the supercritical fluid in the supercritical vessel 6 is stirred by stirring means (FIG. 1(C)). Preferably, the stirring means has a sealed structure such that a stirring shaft or the like does not extend throughout the supercritical vessel. As shown in FIGS. 1(A) to 1(D) and 2(A), the stirring means comprises the jet nozzle 8 which extends inside of the supercritical vessel 6. A circulation port 31 connects an outlet at the top of the supercritical vessel 6 to the jet nozzle 8 through a pump P4, and the supercritical mixture is circulated and compressed by the pump P4 and jetted from the jet nozzle 8 into the supercritical vessel to form a circulation flow within the supercritical vessel to carry out stirring and mixing and accelerate the homogenization process.

Figure 2A:
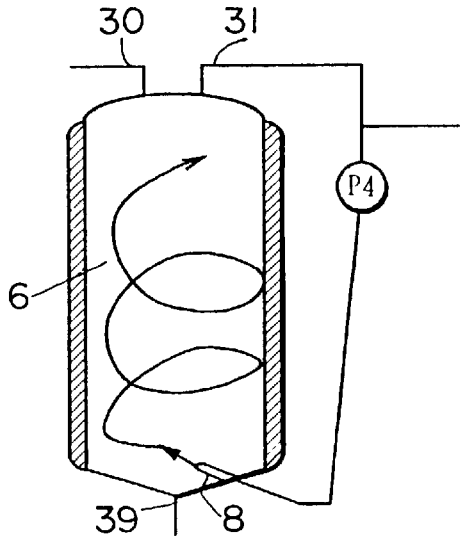
FIGS. 2(A) to 2(D) show stirring means of the dispersing apparatus according to embodiments of the present invention, where.
Figure 2B:
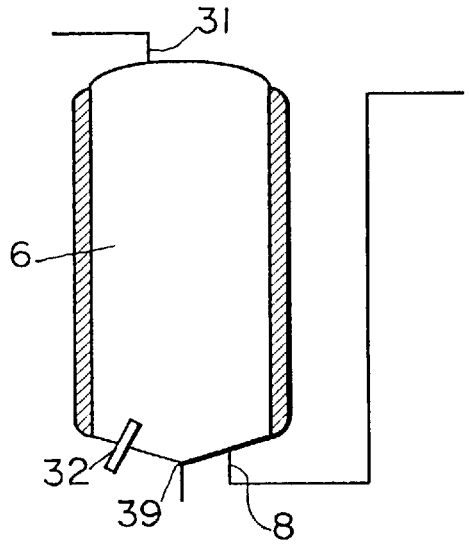

In another embodiment, as shown in FIG. 2(B), the stirring means comprises an ultrasonic wave generator for applying ultrasonic waves into the supercritical vessel 6 to stir the mixture in the supercritical vessel and make it uniform. An ultrasonic wave applying aperture 32 is connected to the vessel and is adapted for connection to the ultrasonic wave generator (not shown).

Figure 2C:
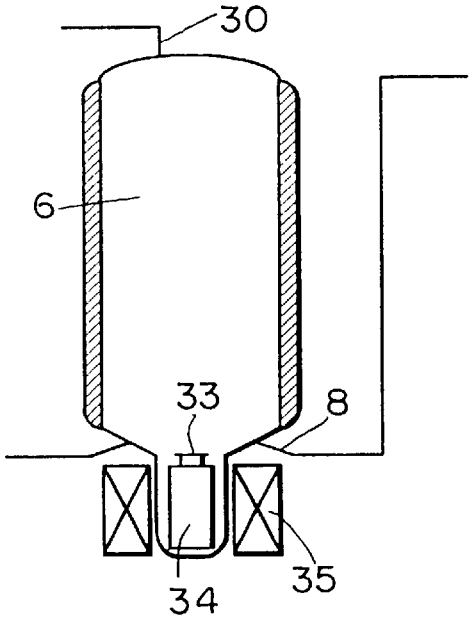

In another embodiment, as shown in FIG. 2(C), the stirring means comprises an electromagnetic coil which generates a shifting magnetic field and which may be provided outside of the supercritical vessel 6 to stir the mixture in the vessel. For example, the stirring means comprises a vibration generating device 34 which is actuated by an external shifting magnetic field of an electromagnetic coil 35 and which has a vibration plate 33 disposed within the vessel. The vibration plate 33 is vibrated by actuating the vibration generating device 34 through the electromagnetic coil 35 which generates the external shifting magnetic field.

Figure 2D:
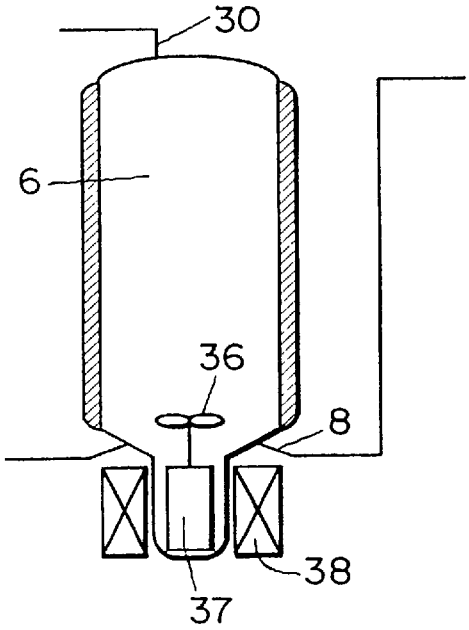

In another embodiment, as shown in FIG. 2(D), the stirring means comprises a rotor 37 which is rotated by an external rotatable shifting magnetic field and which has rotor blades 36. The rotor 37 is provided within the supercritical vessel 6 so that the rotor blades 36 are rotated by actuating the rotor 37 through an electromagnetic coil 38 which generates an external shifting magnetic field.

Figure 1D:
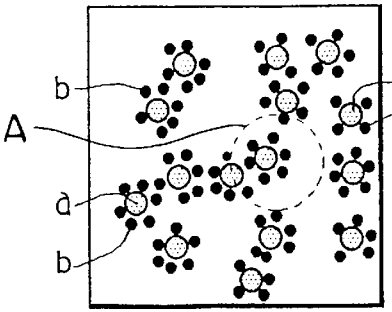
Figure 1E:
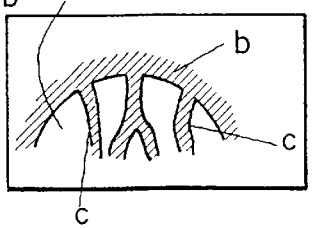
Figure 1I:
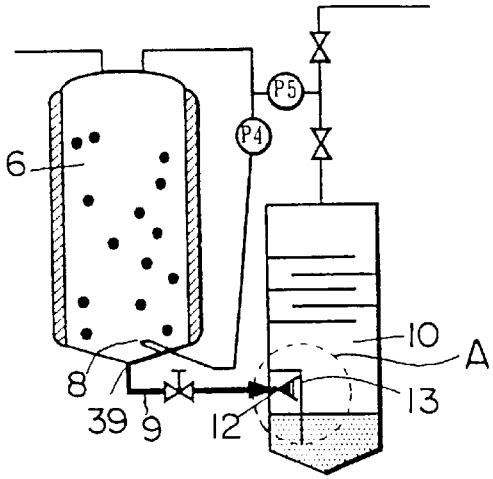
Figure 1J:
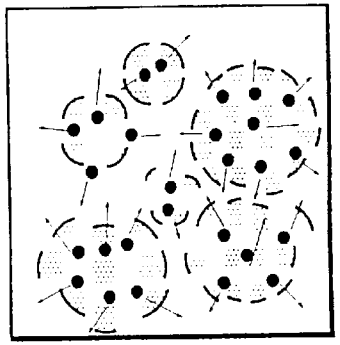
Figure 1F:
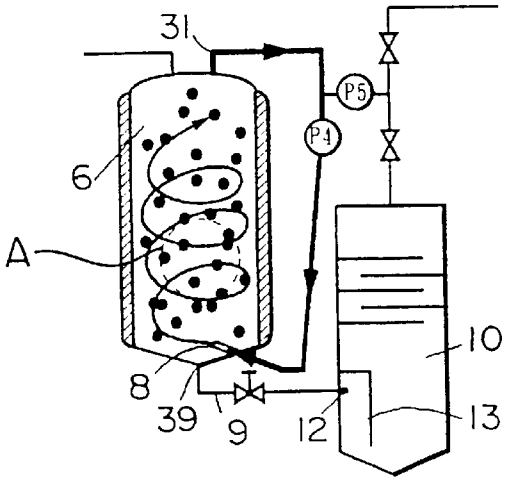
Figure 1H:
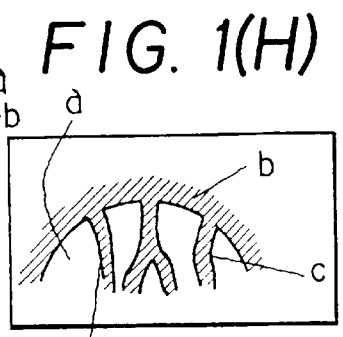
Figure 1G:
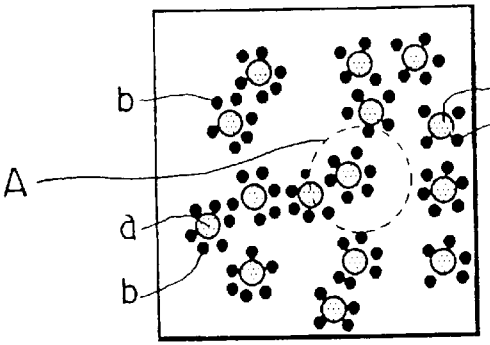

The supercritical mixture, which has been stirred and mixed by one of the various foregoing stirring means, is then discharged from an outlet port 39 of the supercritical vessel 6, introduced into an explosion-crashing tank 10 through a line 9 which is connected to the outlet port 39, jetted within the explosion-crashing tank 10 by releasing it to atmospheric pressure, and collided against a collision portion 13 to accelerate the dispersion by impact action (FIG. 1(D)). A jetting port 12 of the explosion-crashing tank 10 may have the structure of an explosion-crashing nozzle 40 having slits or openings with an appropriate inner diameter (FIG. 3(A)), or an explosion-crashing window 41 having an appropriate aperture area (FIG. 3(B)). The line 9, which connects the explosion-crashing nozzle or the like to the outlet port 39 of the supercritical vessel 6, is preferably heated by a heater (not shown).

Figure 3A:
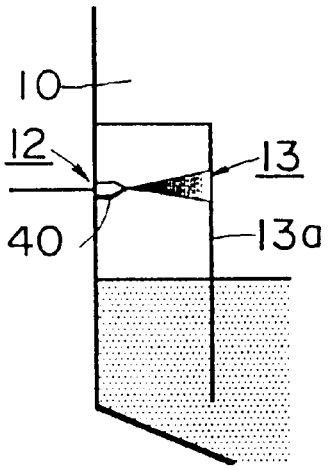
FIGS. 3(A) to 3(C) show collision portions of the explosion-crashing vessel of the dispersing apparatus according to the present invention, where.
Figure 3B:
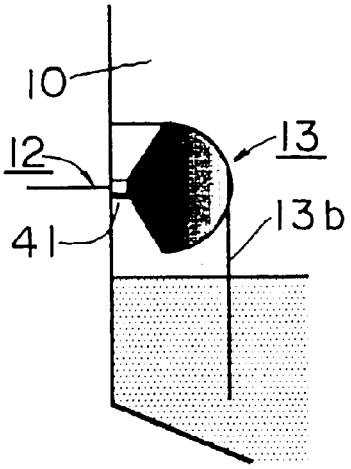

The collision portion 13 in FIGS. 3(A) and 3(B) comprises a collision plate 13 which surrounds the forward portion of the nozzle, window or the like and opens downwardly. In the case of the nozzle 40, a vertical collision plate 13*a* is formed so that it is located vertically to the jetting direction of the nozzle 40. In the case of the explosion-crashing window 41, a semispherical collision plate 13*b* is formed so that it forms a semisphere facing the window 41. In both cases, the dispersion jetted from the nozzle collides in a substantially vertical direction to the wall surface so that the impact force can act effectively.

Figure 3C:
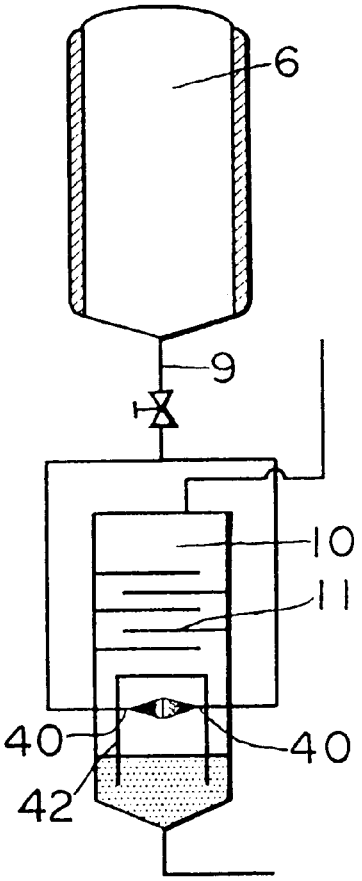

In another embodiment, a collision plate 13 is not used to accelerate the dispersion by impact action. For example, as shown in FIG. 3(C), explosion-crashing nozzles 40,40 are disposed in confronting, face-to-face relation within the explosion-crashing tank 10, the line 9 from the supercritical vessel 6 is divided into two branches connected to the respective nozzles 40,40, and the dispersions are jetted oppositely from the nozzles 40,40, to collide the liquids against each other, whereby the dispersion can be accelerated by the impact at the time of collision. Here, the explosion-crashing nozzles 40,40 are disposed within a hood 42 in the explosion-crashing tank 10, and the dispersion jetted from the two nozzles collide against each other and drop downwardly without scattering to the circumference.

In the explosion-crashing tank 10, since the volume of the supercritical solvent in the aggregates of fine particles is rapidly expanded as mentioned above, the fine particles are further divided into individual particles under the condition of primary particles. At that time, if the fine particles have pores, the fine particles themselves are further crashed and dispersed by the cubical expansion of the supercritical solvent impregnated into the pores.

Figure 4A:
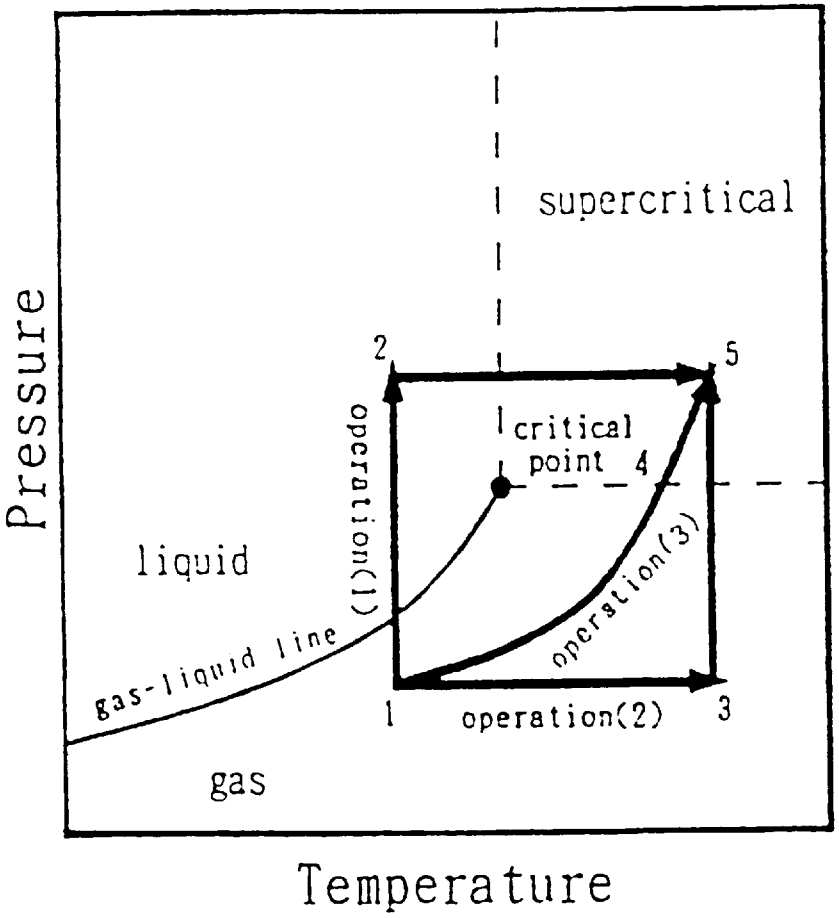
FIGS. 4(A) to 4(C) show operation routes of temperature and pressure in the dispersion method according to the present invention for the preparation of a supercritical state from a supercritical solvent which is in a gaseous state at room temperature and ordinary pressure, where.
Figure 4B:
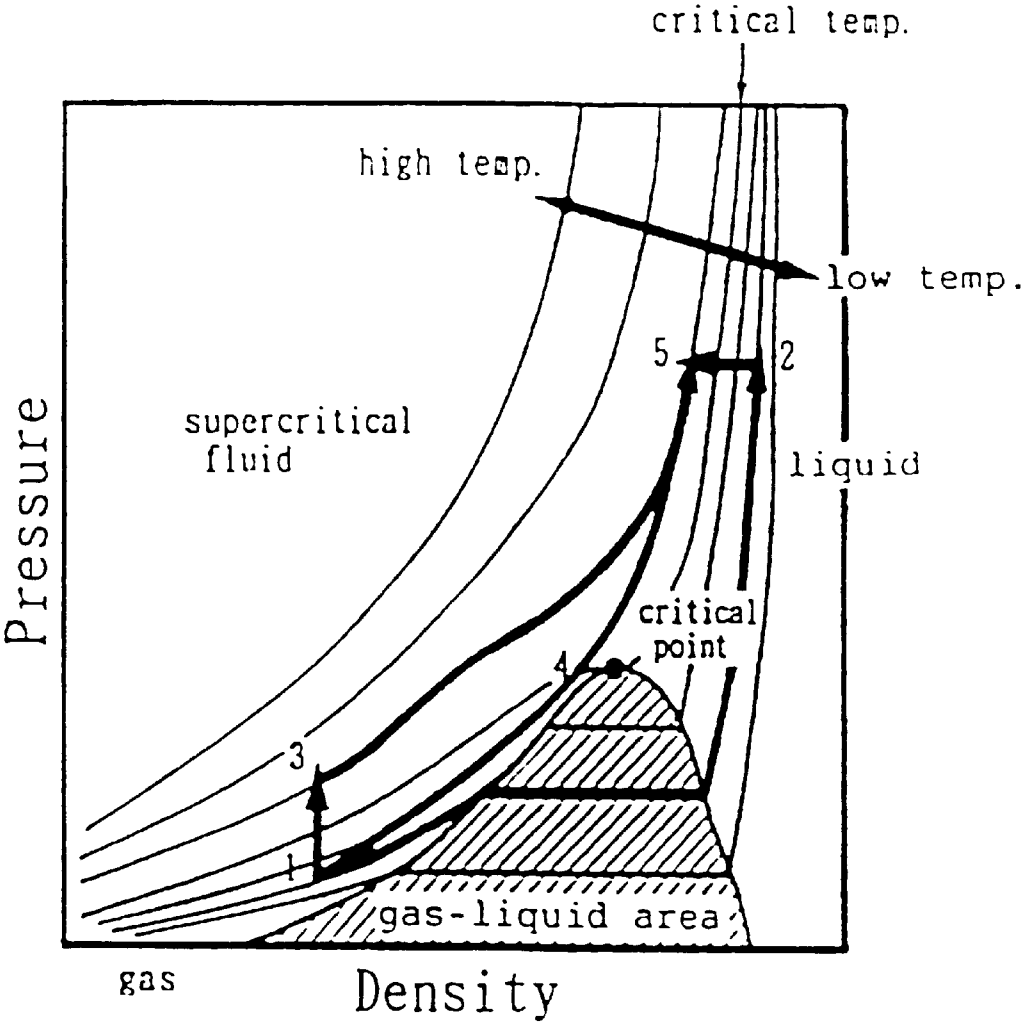
Figure 4C:
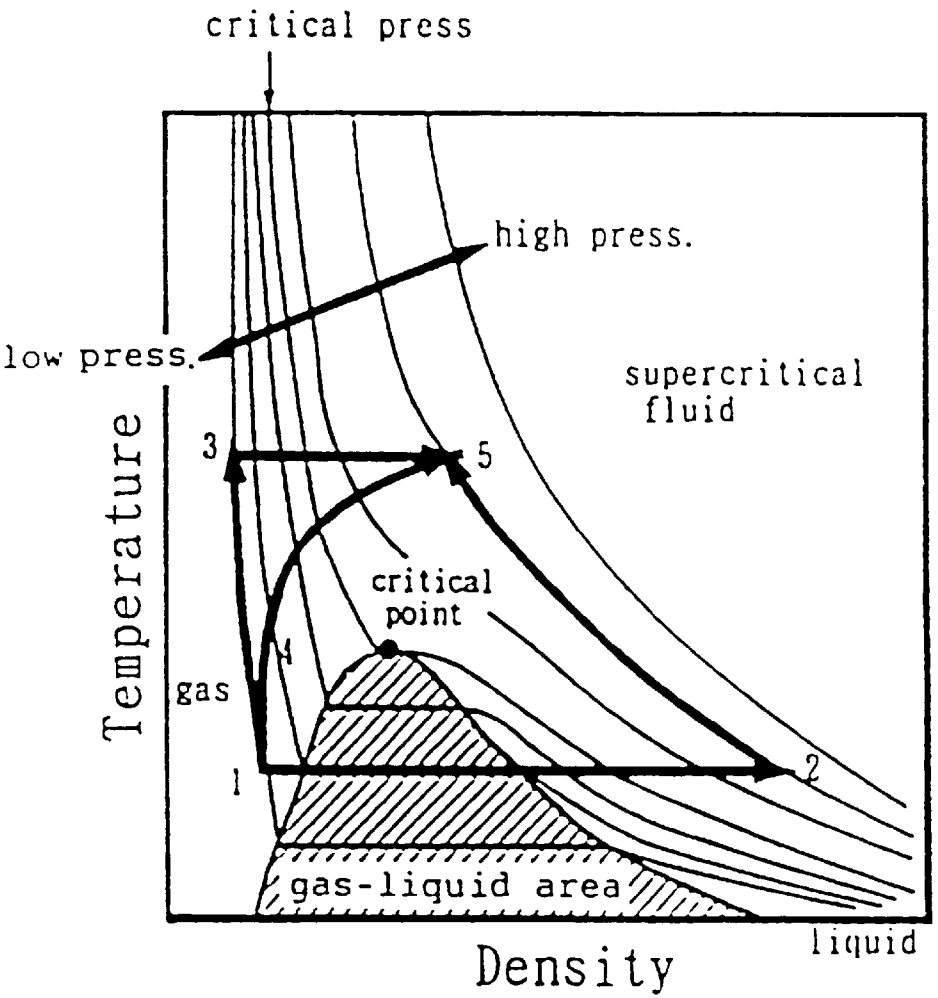

In the above steps, the heating and compressing operation to convert the supercritical solvent to a supercritical fluid is preferably an operation for phase transforming the supercritical solvent from a gaseous phase state to a supercritical state. FIGS. 4(A) to 4(C) show operation routes of temperature and pressure for the transformation to a supercritical state from a supercritical solvent which is in a gaseous state at room temperature and ordinary pressure. FIG. 4(A) shows the steps for temperature-pressure operation. FIG. 4(B) is a density-pressure isothermic chart showing the steps for temperature-pressure operation. FIG. 4(C) is a density-temperature isobar chart showing the steps for temperature-pressure operation. The thick solid lines in these drawings indicate various operation steps.

In the above drawings, the operation step (1) indicated by a route number 1→2→5 shows a change from a gas to a liquid in the route 1→2, and a change from a liquid to a supercritical fluid in the route 2→5. With respect to the relation between the state of the phases and the dispersion of the solid particles in this case, when the line crosses the gas-liquid equilibrium range, the surface of the particles is wetted with a liquid, whereby the supercritical fluid hardly impregnates into narrow spaces or the like between the wetted particles. As a result, the impregnation of the supercritical solvent into the spaces of aggregates of solid particles or into the pores of solid particles is mainly carried out by molecular diffusion by the solvent, such as an organic solvent, in the slurry, and if the supercritical solvent reaches the supercritical state, the effects of the supercritical fluid hardly extend to the spaces of the aggregates of solid particles or the pores of solid particles. Accordingly, the formation of the primary particles by the dispersion or explosion-crashing effect in the supercritical state will be insufficient as mentioned above.

In an operation along a route 1→3→5 as shown in the operation step (2), the supercritical solvent is compressed in the route 1→3 in a gaseous state, and is continuously transformed into a supercritical fluid in the route 3→5. In such a case, since the supercritical solvent is continuously transformed from a gas to a supercritical fluid, the impregnation of the supercritical fluid into the spaces between the aggregates of solid particles or into the pores of solid particles is excellent.

In an operation along a route 1→4→5 as shown in the operation step (3), the supercritical solvent is compressed in the route 1→4 in a gaseous state, and is continuously transformed to a supercritical fluid in the route 4→5. In such a case, the impregnation of the supercritical fluid is excellent as in the above operation step (2), and it is possible to control factors such as pressure, temperature and density, effectively by a computer, whereby most preferred conditions for dispersion of the solid particles can be selected and the dispersion operation can be carried out in a short period of time. As the control of the dispersion in a solid-liquid system, for example, firstly the density of the supercritical fluid is made low to facilitate impregnation, and then the pressure is raised to make the density high for increasing the wettability, followed by the release of the fluid to atmospheric pressure in the explosion-crashing tank.

Figure 5A:
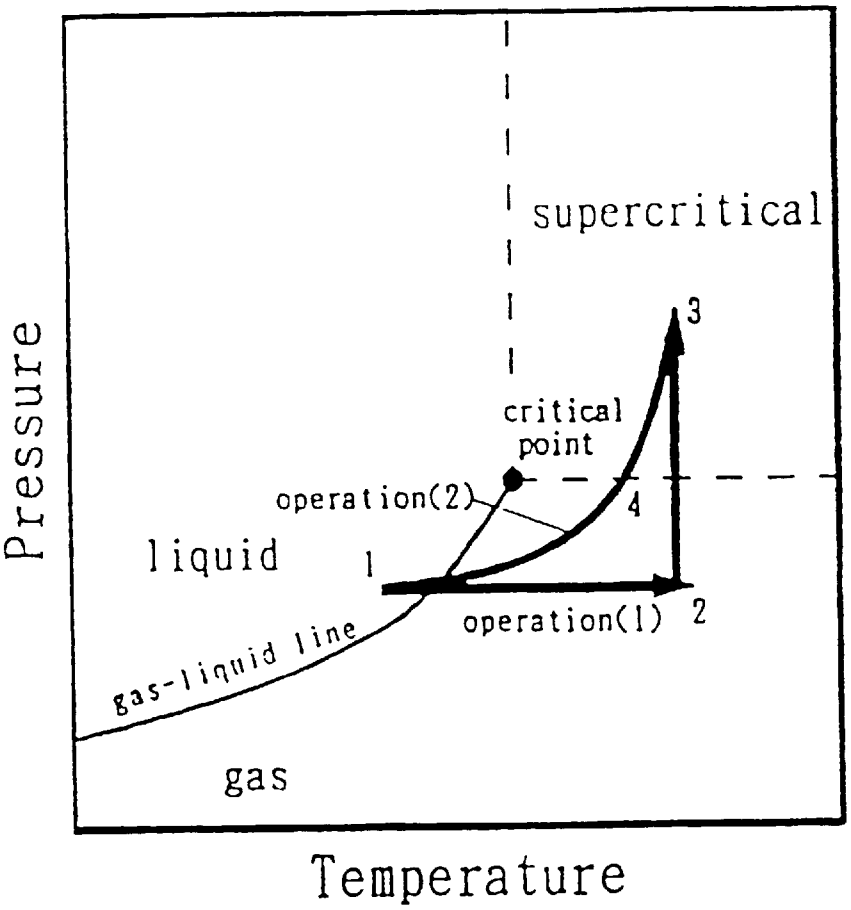
FIGS. 5(A) to 5(C) show operation routes of temperature and pressure in the dispersion method according to the present invention for the preparation of a supercritical state from a supercritical solvent which is in a fluid state at room temperature and ordinary pressure, where.
Figure 5B:
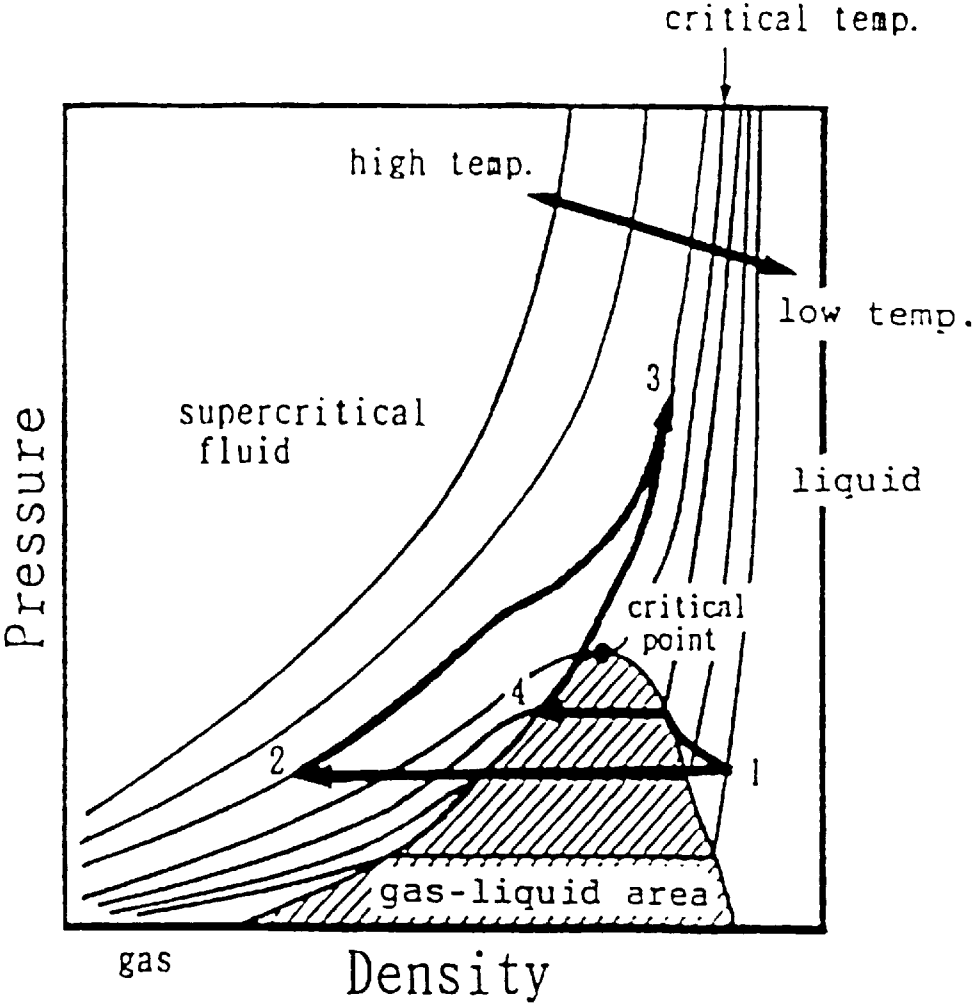
Figure 5C:
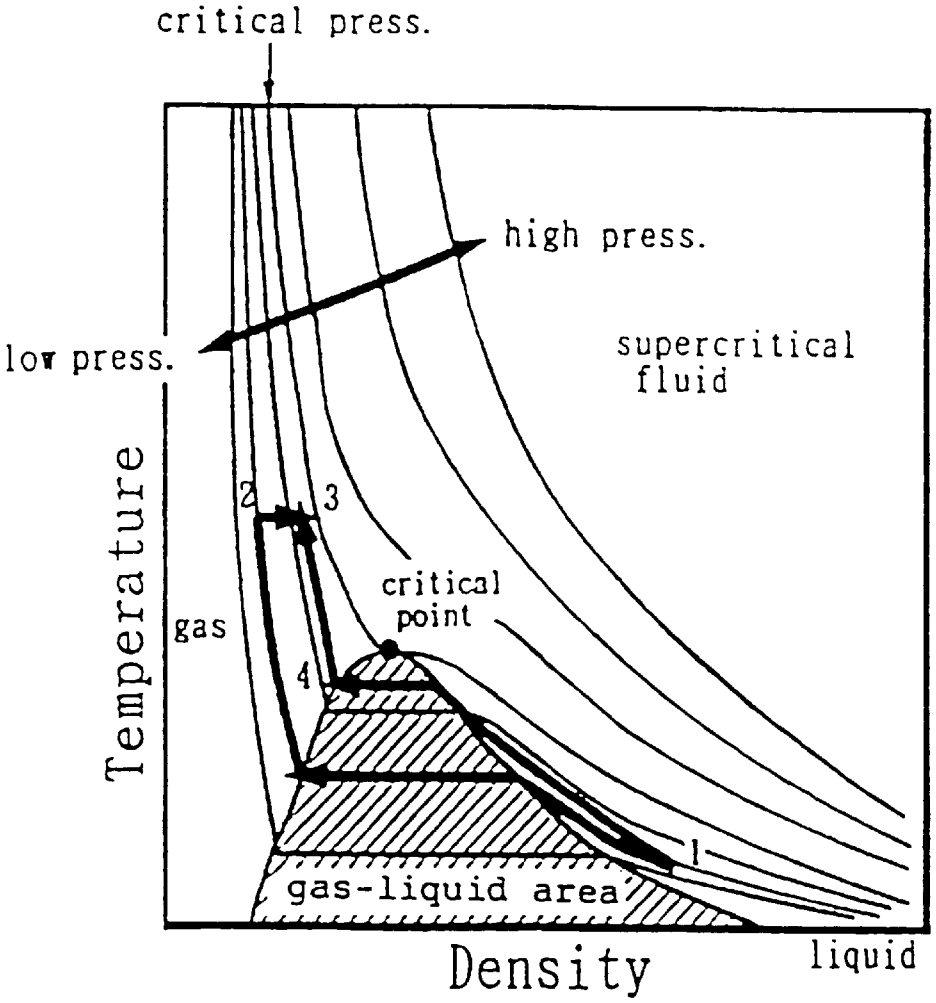

FIGS. 5(A) to 5(C) show operation routes for the preparation of a supercritical state from a supercritical solvent which is in a liquid state at room temperature and ordinary pressure. Like FIGS. 4(A) to 4(C), FIG. 5(A) shows a temperature-pressure operation, FIG. 5(B) shows a density-pressure isothermic chart for a temperature-pressure operation, and FIG. 5(C) shows a density-temperature isobar chart for a temperature-pressure operation. As the operation steps in such cases, as indicated by the route 1→2→3 or the route 1→4→3, the temperature is first raised to a level higher than the critical temperature to carry out the transformation of the supercritical solvent from a liquid to a gas, and then a pressure operation is carried out so that the gas is transformed to a supercritical fluid. At that time, the fluid is subjected to a gas-liquid phase transformation. However, this phase transformation is a phase transformation wherein the density becomes small, and it is believed to cause no effect to the penetration of solid particles into the pores or into the spaces of aggregates between solid particles.

As mentioned above, there are various operation steps for converting a supercritical solvent into a supercritical state. For example, a step for undergoing a phase transformation from a gas to a liquid involves an increase in the density, whereas a step for undergoing phase transformation from a liquid to a gas involves a decrease in the density. The phase transformation involving a decrease in the density does not prevent the supercritical fluid from impregnating into the spaces between the aggregates of solid particles or into the pores of the particles. Therefore, in the present invention, the heating and compressing means are operated so that transformation to the supercritical fluid is carried out through a gaseous state.

FIGS. 6(A) to 6(D) show methods for dispersing droplets wherein a liquid dispersoid is dispersed in a solvent. Here, a liquid solute for dispersion, such as fat balls, is suspended in a solvent such as water or an organic solvent (rough dispersion). Such a suspension is charged as various mixtures of a liquid-liquid system (hereinafter referred to as an emulsion) such as a water-organic solvent system, an organic solute-organic solvent system, and two or more organic solutes-organic solvent systems, into the supercritical vessel 6 from the feeding inlet line 30 (FIG. 6(A)). Additives, such as a dispersant and a reagent, may be added beforehand.

Figure 6C:
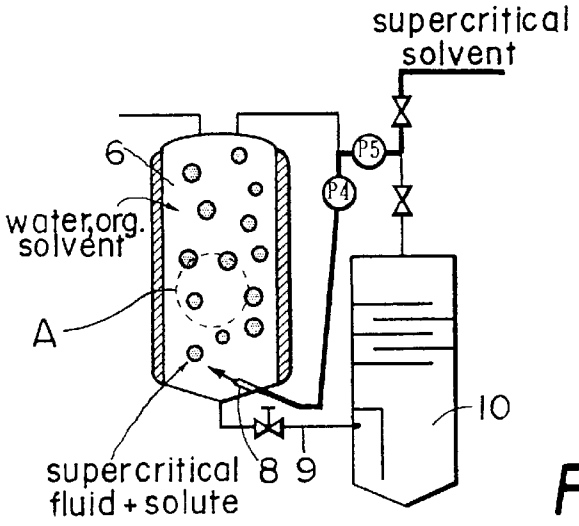
FIGS. 6(A) to 6(D) show dispersion methods for a liquid-liquid system according to the present invention, where.
Figure 6E:
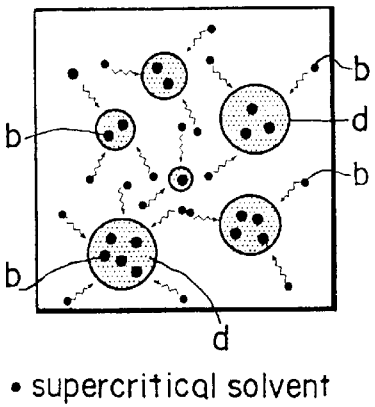
Figure 6D:
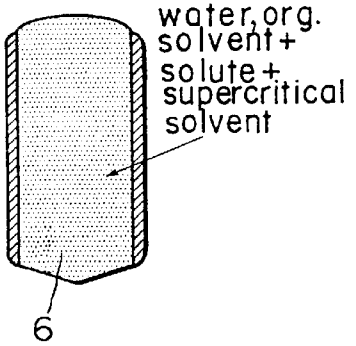
Figure 6A:
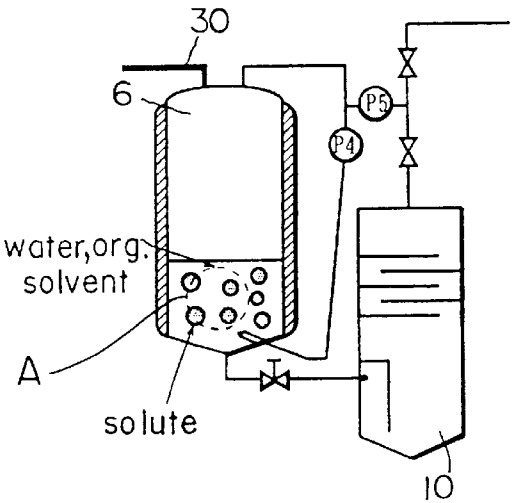
Figure 6B:
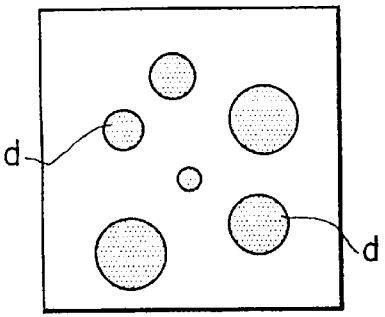

Thereafter, the supercritical vessel 6 is filled with the supercritical solvent from the jet nozzle 8 of the vessel, the temperature and pressure are adjusted to the desired values by heating and compressing means comprising, for example, a heater and a pump, to prepare the supercritical state (FIG. 6(B)). The supercritical fluid b obtained by such an operation generally has a higher affinity with a solute for dispersion as compared with water and, therefore, there are two conceivable cases within the supercritical vessel 6, i.e., a case wherein droplets of a mixture are formed under such a condition that the supercritical fluid b is dissolved in a solute for dispersion d and is dispersed in the solvent such as water or an organic solvent, and the droplets are in a supercritical solvent, as shown in the enlarged figure of part (B-1) in FIG. 6(B); and a case wherein the supercritical fluid, solute for dispersion and the solvent such as water are in a supercritical state under uniform conditions, as shown in the enlarged figure of part (B-2) in FIG. 6(B).

Thereafter, stirring and mixing within the supercritical vessel 6 is carried out by a stirring means (FIG. 6(C)). This figure shows a means in which a supercritical mixture is circulated and compressed by a pump P4 and then jetted into the vessel from the jet nozzle 8. However, other types of stirring means, as shown in FIG. 2(A) to 2(D), can be used. By such an operation, in the state as indicated in the part (B-1) of FIG. 6(B), the formation of fine particles is carried out so that the droplets have a diameter on the order of a sub-micron to a few micrometers. In the state as indicated in part (B-2) of FIG. 6(B), uniformity is further accelerated, and a better dispersion condition can be achieved.

The supercritical mixture which has been stirred and mixed as described above is then introduced from the outlet port 39 of the supercritical vessel 6 to an explosion-crashing tank 10 and jetted into the explosion-crashing tank 10 from the explosion-crashing nozzle or window of the tank (FIG. 6(D)). At this time, in the condition as shown in part (B-1) of FIG. 6(B), the volume of the supercritical solvent in the droplets rapidly increases, whereby the droplets are finely divided for acceleration of the dispersion of the solute. Further, in the condition as shown in part (B-2) of FIG. 6(B), by rapidly evaporating and dispersing the supercritical solvent, the dispersion in a uniform condition becomes an excellent dispersion in such a condition that extremely fine droplets of the solute exist in the liquid. By the impact action of collision of the dispersion against the collision portion as indicated in FIGS. 3(A) to 3(C) disposed within the explosion-crashing tank 10, the dispersion is further accelerated. The foregoing operation can be controlled by a computer, and in such a case, the operation is carried out by, for example, adjusting the supercritical fluid to a high density condition at the initial stage to sufficiently dissolve it in the solute and then releasing the fluid to atmospheric pressure in the explosion-crashing tank 1.

Figure 7:
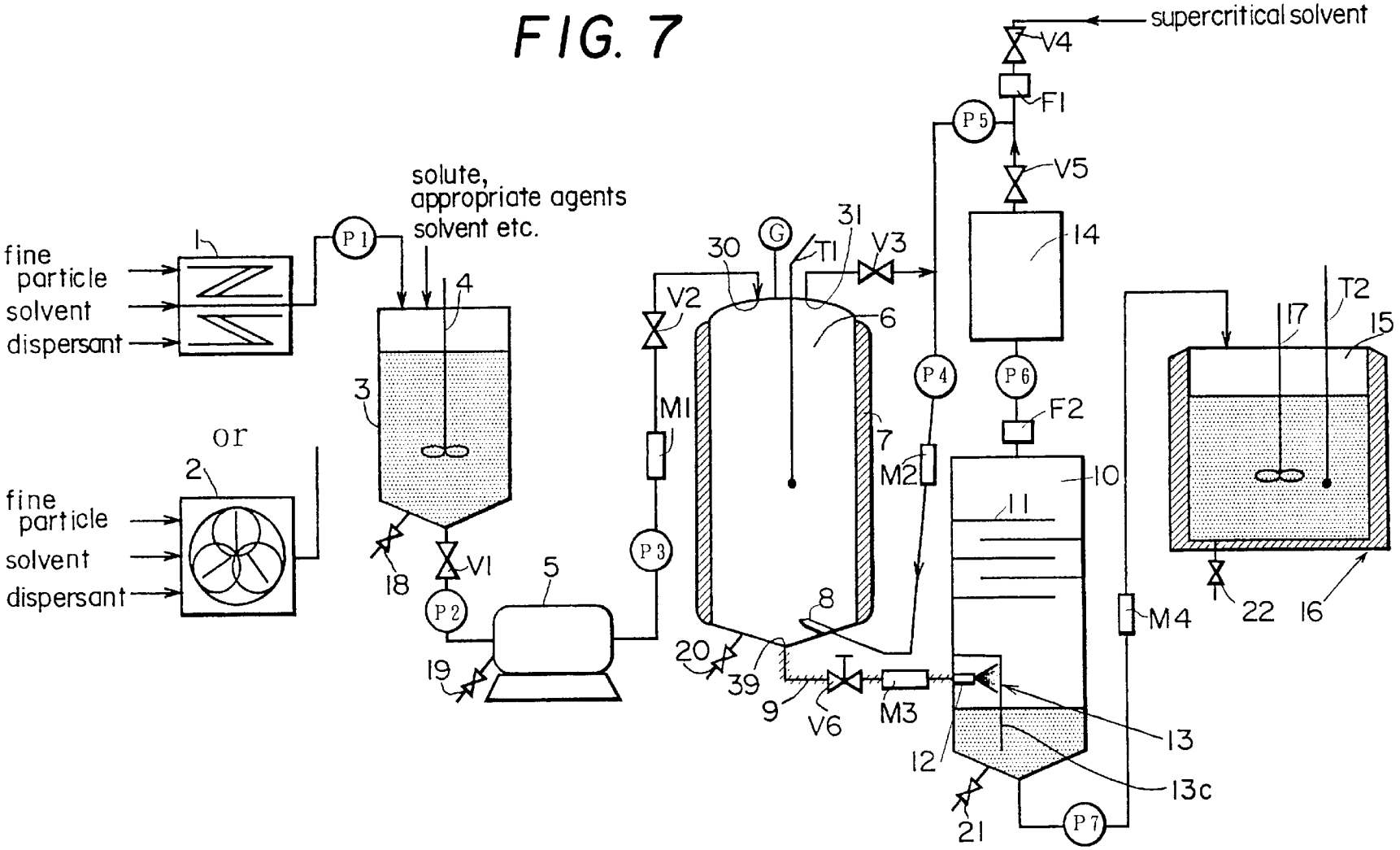
FIG. 7 is an explanatory drawing showing an embodiment of a dispersing apparatus according to the present invention.
Figure 8D:
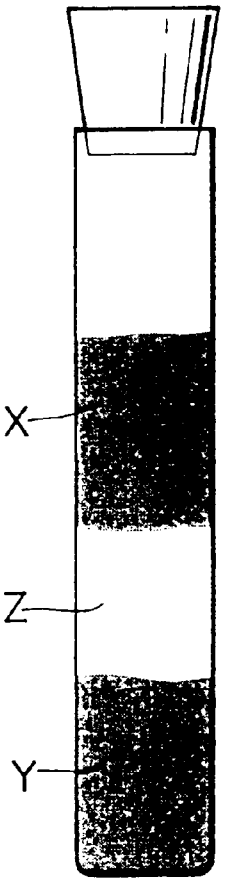
FIGS. 8(A) to 8(D) are explanatory drawings showing dispersed conditions in the examples wherein dispersion is carried out in accordance with the present invention or the comparative examples.
Figure 8C:
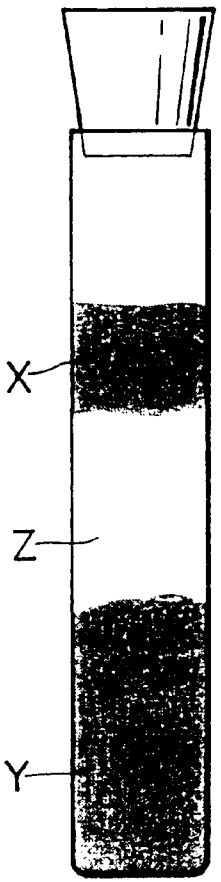
Figure 8B:
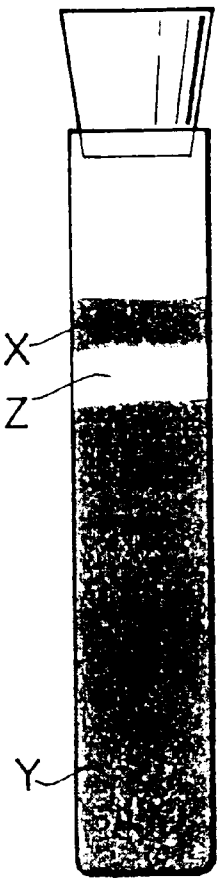
Figure 8A:
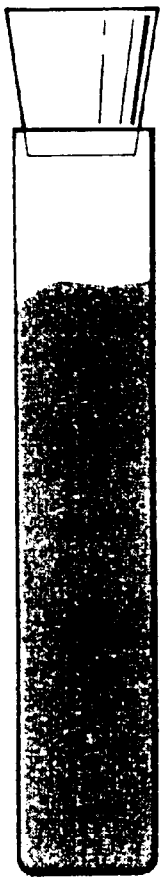

FIG. 7 shows a schematic view of an example of preferred apparatuses for the dispersion system to carry out the above-mentioned dispersion methods.

FIG. 7 shows an example of a preliminary mixing operation when such is desired. A preliminary mixing machine comprises a kneading machine, such as a roll mill or a kneader, or a planetary mixer 2. A dispersoid, a solvent, a dispersant and the like are mixed by the preliminary mixing machine, and this mixture is fed to a dispersion material controlling tank 3 by a pump P1 preferably comprising a snake pump or a screw pump. The controlling tank 3 is preferably equipped with a stirring device 4 to prevent the precipitation or agglomeration of particles or the separation of the solute.

A medium-dispersing apparatus 5 is connected to the controlling tank 3 through a valve V1 and a dispersion material liquid-feeding pump P2. The medium-dispersing apparatus 5 is connected to the feeding inlet 30 of a supercritical vessel 6 through a dispersion material liquid-feeding pump P3, a flow meter M1 and a valve V2. The liquid-feeding pump P3 can achieve compression to a level of 200 atm.

The supercritical vessel 6 is heated by a jacket 7 equipped with temperature controlling means, and a supercritical solvent is fed into the supercritical vessel from a jet nozzle 8. A circulation port 31 is disposed in the supercritical vessel 6 for carrying out the stirring process by jetting as shown, for example, in FIGS. 1(A) to 1(D). The circulation port 31 is connected to the jet nozzle 8 through a valve V3, a circulation pump P4 which has a pressure resistance to a level of 200 atm, and a flow meter M2. A line which is communicated to a feeding source of the supercritical solvent is interposed between the valve V3 and the pump P4 through a valve V4, a filter F1 and a compressor pump P5 for compression.

The supercritical vessel 6 is equipped with a pressure gauge G and a thermometer T1. A line 9 is connected to the outlet port 39 and is equipped with a heating member for which heating is carried out by an external heater to prevent supercooling. The line 9 is connected to an explosion-crashing tank 10 through a reducing valve equipped with an actuator V6 and a flow meter M3.

Screen boards 11 are disposed within the explosion-crashing tank 10 at the upper portion thereof. The line 9 is connected to the jetting port 12 which may be structured as the explosion-crashing nozzle 40 shown in FIG. 3(A) or the explosion-crashing window 41 shown in FIG. 3(B). A collision plate 13 equipped with a fence 13*c* is formed at the forward portion of the jetting port 12. Preferably, the explosion-crashing nozzle 40 is equipped with a heater, as used for the process for producing fine particles using a supercritical fluid, to prevent clogging thereof by freezing of the dispersion.

A buffer tank 14 is connected to the explosion-crashing tank 10 for recovery of the supercritical solvent separated from the dispersion through a filter F2 and a compressor pump P6 for compression. The buffer tank 14 is connected to the pump P5 through a valve V5. Preferably, each of the valves V1 to V5 comprises a stop valve, such as a ball valve with an actuator. Each of the filters F1, F2, etc., preferably comprises a metal sintered porous body, ceramics or the like.

A storage tank 15, such as a deaeration tank, is connected to the lower portion of the explosion-crashing tank 10 through a liquid-feeding pump P7 and a flow meter M4. The storage tank 15 is heated by a heating jacket 16 equipped with temperature controlling means for controlling the temperature of the storage tank. The dispersion is stirred and mixed by a stirring machine 17. The storage tank 15 is equipped with a thermometer T2. Further, if desired, at the upper portion of the storage tank 15, a recovery apparatus which communicates to the buffer tank 14 may be provided for the recovery of the unrecovered supercritical solvent separated from the dispersion.

Discharge ports 18, 19, 20, 21 and 22, each equipped with a valve, are provided at the dispersion material controlling tank 3, the medium-dispersing apparatus 5, the supercritical vessel 6, the explosion-crashing tank 10 and the storage tank 15, respectively, for discharging the washing liquids thereof. Further, the temperature data obtained by the thermometers T1 and T2, the pressure data obtained by the pressure gauge G, and the flow rate data obtained by the flow meters M1 to M4 are sent to a computer for processing and then signals are sent to the pumps P1 to P7, the actuators of the valves V1 to V5, the temperature controllers of the heating jackets 7 and 16, the heater of the line 9, etc., for controlling the liquid feeding rate of each pump, the opening and shutting of the valves, the heating rate of the jackets and heaters, and the like.

The operational procedures of the above systems will be explained below. In the case of a solid-liquid system, the dispersoid contains ultrafine particles such as a pigment, ceramic material powder or magnetic particles, and may sometimes contain various types of fine particles. In the case of a liquid-liquid system, there are two cases: (1) a liquid-liquid system of water and a solute, such as, for example, a hydrophobic liquid such as a fat, an organic agent and a monomer, and (2) a liquid-liquid system of an organic solvent and a solute for dispersion, insoluble in the organic solvent such as a fat, an organic agent and a monomer. Such a dispersoid is mixed with a solvent such as water or an organic solvent and, if desired, with an agent (a dispersant for accelerating the dispersion of fine particles or a solute, or a surface modifier for imparting various functions to the surface of fine particles, a coating agent, etc.), and then adjusted to a desired concentration for a liquid-like dispersion (a slurry or an emulsion). At this stage, the valves V1, V2 and V4 are closed, and the valves V3, V5 and V6 are opened.

Thereafter, the valve V4 is opened (the valves V1 and V2 are closed, and the valves V3, V5 and V6 are opened) and a supercritical solvent such as carbon dioxide, ethylene or a substitute for Freon is fed to the supercritical vessel 6, the explosion-crashing tank 10, the buffer tank 14 and the like, to substitute the internal atmosphere within the vessel and tanks by the supercritical solvent.

After the substitution process, the valves V3 to V6 are closed, and the valves V1 and V2 are opened. The dispersion material in the dispersion material controlling tank 3 is fed to the medium-dispersing apparatus 5 by the pump P2 and mixed with a dispersoid, a solvent and an agent into a more uniform condition. If the dispersion material is already dispersed in a sufficiently uniform condition by stirring within the dispersion material-controlling tank 3, then the medium-dispersing apparatus 5 and attachments such as the discharge port 19 for discharging the washing liquid, the valve V1 and the pump P2 may be omitted. A desired amount of the dispersion material is then charged into the supercritical vessel 6 under the increased pressure by the pump P3.

Thereafter, the valves V1 and V2 are closed, and the valve V4 is opened (under the condition that the valves V3, V5 and V6 are closed), and the supercritical vessel 6 is filled with the supercritical solvent. To obtain the desired temperature (a temperature which does not impair the properties of the dispersoid and is not less than the critical temperature) and the desired pressure (at a level of about two times the critical pressure), the temperature is raised by the jacket 7 and the pressure is increased by the pump P5 to bring about the supercritical state. An optimum operation for the dispersoid to be treated is carried out as explained with respect to the above-mentioned FIGS. 4 to 5.

The valve V4 is then closed and the valve V3 is opened. At this time, the valves V1, V2, V5 and V6 are under the closed condition and, therefore, the supercritical vessel 6 is under such condition that it is isolated from the external side. The dispersion material compressed by the pump P4 is then jetted from the jet nozzle 8 and the contents within the supercritical vessel 6 are stirred by a jet flow to accelerate the dispersion.

The valve V3 is then closed and the valve V6 is opened (the valves V1, V2, V4 and V5 are under the closed condition) to jet the dispersion into the explosion-crashing tank 10 through the jetting port 12. The dispersion operation progresses further by the explosion-crashing effect of the expansion of the supercritical solvent or by the collision against the collision plate equipped with the fence 13 (a countercurrent collision may be used). Since the above effect of progressing the dispersion deteriorates with reduction of the pressure in the supercritical vessel 6, the jetting of the dispersion is carried out until the pressure in the vessel reaches a level of the supercritical state while monitoring the pressure in the vessel 6.

In the explosion-crashing tank 10, the supercritical solvent is vaporized from the dispersion for separation. The supercritical solvent which is splashed at the section of the screen boards 11 is collected at the lower portion of the explosion-crashing tank 10, compressed with a compressor pump P6 through the filter F2, recovered and stored in a liquid state within the buffer tank 14, and then recycled as further described below.

The dispersion is then sent to a storage tank 15 by a pump P7. In the storage tank 15, heating is carried out by the jacket 16 to evaporate the unrecovered supercritical solvent for separation, followed by concentration of the dispersoid to the desired level.

The valves V3 and V6 are then closed and the valves V1 and V2 are opened to fill the vessel 6 with the dispersion such as a slurry or an emulsion for the next cycle. In this case, when the filling of the supercritical solvent is conducted, the valve V5 is opened while keeping the valves V1, V2, V3, V4 and V6 in a closed condition, and firstly the supercritical solvent in the buffer tank 14 is used, and then the valve V5 is closed and the valve V4 is opened to feed the supercritical solvent for supplementing a shortage.

EXAMPLES

Using carbon dioxide as a supercritical solvent, experiments for dispersing carbon black (carbon ECP manufactured by Ketchen Black International K.K.) into pure water were carried out to obtain the following samples (A) to (D).

Sample (A)

2 wt % of the above carbon black was charged into pure water and subjected to the following operations, which correspond to the operation step 3 in FIGS. 4(A) to 4(C), followed by explosion-crashing:

(20° C., 1 atm)–(5 min.)→(20° C., 20 atm)–(5 min.)→(50° C., 50 atm)–(5 min.)→(60° C., 100 atm)–(5 min.)→(explosion-crashing)→(20° C., 1 atm)

In the foregoing operations, the sample is successively maintained under the condition of 20° C., 1 atm for five minutes, under the condition of 20° C., 20 atm for five minutes, under the condition of 50° C., 50 atm for five minutes, and under the condition of 60° C., 100 atm for five minutes, and then explosion-crashing operation is carried out on the sample to bring the sample under the condition of 20° C., 1 atm. The above explanation is also applicable to the operation steps of Samples (B) and (E).

Sample (B)

2 wt % of the above carbon black was charged into pure water and subjected to the following operations which correspond to the operation step 1 in FIGS. 4(A) to (C), followed by explosion-crashing:

(20° C., 1 atm)–(7 min.)→(20° C., 100 atm)–(8 min.)→(60° C., 100 atm)–(5 min.)→(explosion-crashing)

Sample (C)

2 wt % of the above carbon black and 3 wt % of a dispersant were charged into pure water, and then dispersion was carried out for 2 hours by using a stirring device having four blades.

Sample (D)

2 wt % of the above carbon black was charged into pure water, and then dispersion was carried out for 2 hours by using a stirring device having four blades.

RESULTS

The foregoing Samples (A) to (D) were left to stand still in test tubes for 100 hour, and then compared to determine the differences as indicated in the explanatory drawing of FIGS. 8(A) to 8(D), respectively.

Sample (A) was uniformly dispersed even after 100 hours and maintained in a dispersed condition without reagglomeration.

Sample (B) underwent a slight reagglomeration (X) or precipitation (Y), and a partial separation of water (Z), thereby showing a poor dispersed condition as compared with Sample (A).

Sample (C) and Sample (D) started separation into water and carbon black after 1 hour, thereby showing an extremely poor dispersed condition.

Furthermore, the roughness of the sample was measured by using a grindometer (JIS-K5400) (JIS=Japanese Industrial Standard) having a measuring range of from 0 μm to 50 μm. The result was that no particles having a diameter of more than 5 μm were found with respect to Sample (A) and Sample (B), whereas the presence of particles having a diameter of 33 μm was observed with respect to Sample (C), and the presence of particles having a diameter of 40 μm was observed with respect to Sample (D).

As is apparent from the above results, an excellent dispersed condition can be obtained by the dispersion method employing the supercritical state of the present invention and the apparatus thereof.

Moreover, Sample (E) as indicated below was prepared for the confirmation of the explosion-crashing effect according to the present invention.

Sample (E)

2 wt % of the above carbon black was charged into pure water and subjected to the following operations which correspond to the operation step 3 in FIGS. 4(A) to 4(C), followed by mild reduction of pressure (namely, no explosion-crashing was carried out):

(20° C., 1 atm)–(5 min.)→(20° C., 20 atm)–(5 min.)→(50° C., 50 atm)–(5 min.)→(60° C., 100 atm) –(5 min.)→(60 min.)→(20° C., 1 atm)

RESULTS

Figure 9:
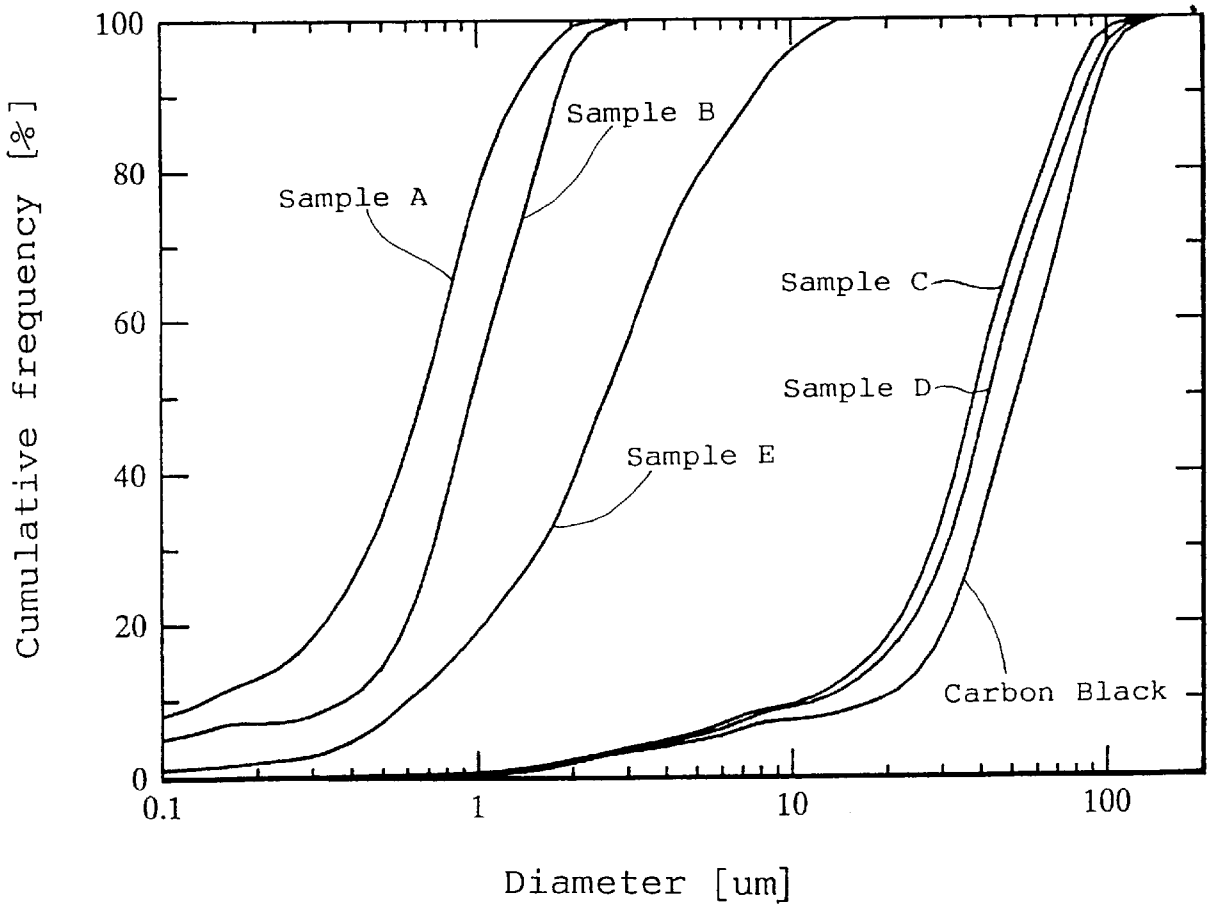
FIG. 9 is a chart showing particle size distributions in the examples wherein dispersion is carried out in accordance with the present invention or the comparative examples.

Using a particle size distribution-measuring machine which uses a light scattering method (Laser Micronsyzer, Model PRO-7000s, manufactured by Kabushiki Kaisha Seishin Kigyo), the particle size distribution of the carbon black in each of the above-mentioned Samples (A) to (D) and in the dispersion of Sample (E) was measured, and the results shown in FIG. 9 were obtained. As is apparent from the measurement results, Samples (A) and (B), in which the explosion-crashing operation was conducted, show highly uniform particle size distributions as compared with Sample (E), whereby the effects of the explosion-crashing were confirmed.

According to the present invention described above, the dispersoid and the solvent are mixed, and this mixture is mixed with a supercritical fluid in the supercritical vessel, and the resulting supercritical mixture is then jetted in the explosion-crashing tank for explosion-crashing. By such a method, in a solid (fine particles)-liquid system dispersion, the supercritical fluid in a low density condition (i.e., diffusion coefficient is large and viscosity is small) penetrates into the spaces of the aggregates of fine particles or into the pores of the fine particles, and then the pressure is increased to make the density of the fluid high (i.e., intermolecular action is large and wettability of the fine particles is high) to accelerate the formation of primary fine particles. A rapid reduction of pressure (release to atmospheric pressure) is carried out to make the density of the fluid small (the volume is made large), whereby effective dispersion can be carried out and reagglomeration after the dispersion is unlikely to take place. Further, in a liquid (dispersoid)-liquid (water) system dispersion, by using a high solubility under a high density condition, the supercritical fluid is dissolved into droplets of dispersoid present in the liquid (water) (in some cases, a homogeneous condition of water-dispersoid-supercritical fluid), and the rapid reduction of pressure is carried out (release to atmospheric pressure) to rapidly reduce the density (the volume is made large), whereby the dispersion is accelerated and reagglomeration is unlikely to take place. In the case of a slurry having a high viscosity, the introduction of the supercritical fluid can remarkably reduce the viscosity, by which the jetting from the nozzle or the like facilitates crashing and dispersion.

Furthermore, the operation for accelerating the wetting of the surface of the solid particles or wetting the inside of the pores with the supercritical solvent and for the formation of the dispersed condition of primary particles can properly be controlled by a computer by selecting the optimum operation route of the temperature and pressure. By such effects, further improved dispersion can be provided by the collision portion of the explosion-crashing tank at the time of release to the atmospheric pressure, and the supercritical solvent can be recovered for recycling, whereby a resources-saving type dispersion system can be obtained.

We claim:

1. A dispersion method using a supercritical state, comprising the steps of: feeding a mixture of a dispersoid and a solvent into a supercritical vessel; feeding a supercritical solvent into the supercritical vessel; heating and compressing the supercritical solvent to convert it from a gaseous phase state to a supercritical fluid; mixing the mixture and the supercritical fluid in the supercritical vessel to obtain a supercritical mixture; and introducing the supercritical mixture to an explosion-crashing tank to release the supercritical mixture to atmospheric pressure and to collide the supercritical mixture with a collision portion of the explosion-crashing tank to effect dispersion of the dispersoid.

2. A dispersion method according to claim 1; wherein the supercritical solvent is separated from the supercritical mixture in the explosion-crashing tank, and the separated supercritical solvent is recovered and fed to the supercritical vessel.

3. A dispersion method according to claim 1; wherein the mixture of the dispersoid and solvent comprises a slurry having a solid dispersoid suspended in a solvent comprised of an organic solvent or water.

4. A dispersion method according to claim 1; wherein the mixture of the dispersoid and solvent comprises an emulsion having a liquid type solute suspended in a solvent comprised of an organic solvent or water.

5. A dispersion method according to claim 1; wherein the mixture of the dispersoid and solvent is a slurry having solid and liquid dispersoids suspended in a liquid solvent.

6. A dispersion method using a supercritical state, comprising the steps of: introducing a supercritical fluid into a mixture of a dispersoid and a solvent to obtain a supercritical mixture having a reduced viscosity; and jetting the reduced viscosity supercritical mixture under reduced pressure to impart to the dispersoid a volume-expansion action, a high shearing action and an impact action while releasing the reduced viscosity supercritical mixture to atmospheric pressure to thereby crash and disperse the dispersoid.

7. A dispersing apparatus comprising: a supercritical vessel having a feeding portion for charging a mixture of a dispersoid and a solvent, a feeding port for charging a supercritical solvent, and an outlet port; heating and compressing means for converting the supercritical solvent within the supercritical vessel to a supercritical fluid; stirring means for stirring a supercritical mixture comprised of the dispersoid and solvent mixture and the supercritical fluid in the supercritical vessel; an explosion-crashing tank connected to the outlet port of the supercritical vessel and having a jetting port for releasing the supercritical mixture to atmospheric pressure to effect dispersion of the dispersoid; and a storage tank for storing the dispersoid obtained in the explosion-crashing tank.

8. A dispersing apparatus according to claim 7; wherein the supercritical solvent is separated from the supercritical mixture in the explosion-crashing tank; and further comprising a buffer tank connected to the explosion-crashing tank for recovering the supercritical solvent separated in the explosion-crashing tank, the buffer tank being connected to the feeding port of the supercritical vessel for feeding the supercritical solvent to the supercritical vessel.

9. A dispersing apparatus according to claim 7; further comprising a preliminary mixing apparatus for preliminarily mixing the dispersoid and the solvent, the preliminary mixing apparatus being connected to the feeding port of the supercritical vessel for feeding the mixture of the dispersoid and the solvent to the supercritical vessel.

10. A dispersing apparatus according to claim 7; wherein the heating and compressing means includes means for converting the supercritical solvent from a gaseous phase state to the supercritical fluid.

11. A dispersing apparatus according to claim 7; wherein the stirring means comprises a nozzle disposed inside the supercritical vessel, and means including a circulating pump for circulating the supercritical mixture taken out from one portion of the supercritical vessel back into the supercritical vessel through the nozzle.

12. A dispersing apparatus according to claim 7; wherein the stirring means comprises ultrasonic wave generating means for generating an ultrasonic wave and applying the ultrasonic wave to the supercritical vessel for stirring the supercritical mixture.

13. A dispersing apparatus according to claim 7; wherein the stirring means comprises a vibration plate disposed in the supercritical vessel, and an electromagnetic coil for generating a shifting magnetic field for driving the vibration plate.

14. A dispersing apparatus according to claim 7; wherein the stirring means comprises a plurality of rotor blades disposed in the supercritical vessel, and an electromagnetic coil for generating a shifting magnetic field for driving the rotor blades.

15. A dispersing apparatus according to claim 7; wherein the explosion-crashing tank has a collision portion against which the supercritical mixture is collided.

16. A dispersing apparatus according to claim 15; wherein the jetting port of the explosion-crashing tank terminates in a nozzle; and wherein the collision portion of the explosion-crashing tank is disposed generally vertical to a jetting direction of the nozzle.

17. A dispersing apparatus according to claim 15; wherein the jetting port of the explosion-crashing tank comprises an explosion-crashing window; and wherein the collision portion of the explosion-crashing tank has a generally semi-spherical shape.

18. A dispersing apparatus according to claim 7; wherein the jetting port of the explosion-crashing tank terminates in a pair of nozzles disposed in confronting face-to-face relation for releasing the supercritical mixture in jet streams toward each other to collide the jet streams with one another.

19. A dispersing apparatus comprising: a jetting port having a nozzle for jetting a supercritical mixture of a dispersoid, a solvent, and a supercritical fluid under a reduced pressure; and impacting means for releasing the supercritical mixture to atmospheric pressure and effecting collision of the jetted supercritical mixture to thereby effect dispersion of the dispersoid.

20. A dispersing apparatus according to claim 19; wherein the impacting means comprises a collision surface disposed in the path of the jetted mixture whereby the dispersoid in the jetted mixture impacts the collision surface and undergoes dispersion.

21. A dispersing apparatus according to claim 20; wherein the collision surface comprises a collision plate disposed in spaced relation opposite to the jetting port.

22. A dispersing apparatus according to claim 19; wherein the impacting means comprises a nozzle in confronting, face-to-face relation with the nozzle of the jetting port whereby the mixtures jetted from both nozzles collide against each other and the dispersoid in the colliding mixtures undergoes dispersion.

23. A method of dispersing a dispersoid, comprising the steps of: providing a vessel; charging a mixture of a dispersoid and a solvent into the vessel; charging a supercritical solvent in a gaseous state into the vessel; converting the supercritical solvent into a supercritical fluid; mixing the dispersoid/solvent mixture and the supercritical fluid in the vessel to obtain a supercritical mixture; introducing the supercritical mixture to an explosion-crashing tank having a collision portion to release the supercritical mixture to atmospheric pressure; and colliding the supercritical mixture with the collision portion of the explosion-crashing tank to thereby disperse the dispersoid in the solvent.

24. A dispersing apparatus comprising: a vessel; a heating and compressing unit for converting a supercritical solvent in the vessel to a supercritical fluid; a stirring device for stirring a mixture of a dispersoid and a solvent in the vessel with the supercritical fluid to obtain a supercritical mixture; and an explosion-crashing tank connected to receive the supercritical mixture from the vessel for releasing the supercritical mixture to atmospheric pressure and having a collision portion for effecting collision of the supercritical mixture to thereby disperse the dispersoid in the explosion-crashing tank.

25. A dispersing apparatus according to claim 24; further comprising a storage tank for storing the dispersoid which has been dispersed in the explosion-crashing tank.

* * * * *